US006393864B1

(12) United States Patent
Darredeau

(10) Patent No.: US 6,393,864 B1
(45) Date of Patent: May 28, 2002

(54) BATH REBOILER-CONDENSER CONSISTING OF BRAZED PLATES AND ITS APPLICATION TO AN AIR DISTILLATION PLANT

(75) Inventor: Bernard Darredeau, Sartrouville (FR)

(73) Assignee: L'air Liquide, Societe Anonyme pour l'etude et l'Exploitation des Procedes Georges Claude, Paris Cedex (FR)

( * ) Notice: Subject to any disclaimer, the term of this patent is extended or adjusted under 35 U.S.C. 154(b) by 0 days.

(21) Appl. No.: 09/613,334

(22) Filed: Jul. 7, 2000

(30) Foreign Application Priority Data

Jul. 7, 1999 (FR) ..... 99 08791

(51) Int. Cl.[7] ..... F25J 1/00
(52) U.S. Cl. ..... 62/643
(58) Field of Search ..... 62/643, 903

(56) References Cited

U.S. PATENT DOCUMENTS 3,256,704 A * 6/1966 Becker ..... 62/42
4,606,745 A 8/1986 Fujita
4,715,433 A * 12/1987 Schwartz et al. ..... 165/110
5,682,945 A * 11/1997 Lehman ..... 165/111
5,775,129 A 7/1998 Satchell, Jr. et al.
5,857,517 A * 1/1999 Genier et al. ..... 165/166
5,901,574 A 5/1999 Rohde
5,904,205 A * 5/1999 Grenier et al. ..... 165/166
6,189,338 B1 * 2/2001 Lehman ..... 62/643

FOREIGN PATENT DOCUMENTS

DE 1 152 432 8/1963

* cited by examiner

*Primary Examiner*—William Doerruer
*Assistant Examiner*—Malik N. Drake
(74) *Attorney, Agent, or Firm*—Young & Thompson

(57) ABSTRACT

This reboiler-condenser (1) comprises two exchanger parts (2A, 2B) one placed above the other. The lower part (2A), immersed in the liquid, has supplied vaporization passages (8A). The vapour which leaves therefrom is sent to the inlet of the vaporization passages (8B) of the upper part and liquid is delivered into the stream of vapour which penetrates each of these passages.

Application to the vaporization of liquid oxygen by the condensation of nitrogen.

9 Claims, 2 Drawing Sheets

BATH REBOILER-CONDENSER CONSISTING OF BRAZED PLATES AND ITS APPLICATION TO AN AIR DISTILLATION PLANT

The present invention relates to a bath reboiler-condenser of the type consisting of brazed plates.

The invention applies in particular to the main reboiler-condensers of air distillation plants, which vaporize low-pressure liquid oxygen (typically at a pressure slightly greater than atmospheric pressure) by the condensation of medium-pressure nitrogen (typically at 5 to 6 bar absolute), and it will be explained below in this application.

Bath reboiler-condensers operate as a thermosiphon. The upflow of the vaporizing oxygen is provided by the hydrostatic pressure due to the head of the liquid oxygen bath.

For safety reasons, the recirculating liquid oxygen flow rate must be several times greater than the vaporized oxygen flow rate. For this reason, the head of the liquid oxygen bath must be approximately equal to the height of the exchanger, that is to say the latter is almost completely immersed in the liquid.

If it is desired to reduce the temperature difference between the fluid which condenses and that which vaporizes, so as to reduce the pressure of the heating nitrogen and therefore the energy required to compress the treated air, the heat-exchange area must be increased. Since the horizontal dimensions of the exchanger are limited by the space available in the bottom of the low-pressure distillation column, the height of the exchanger must be increased.

However, such an increase in the height increases the hydrostatic pressure of the liquid at the bottom, that is to say at the inlet of the vaporization passages, thereby creating, in the lower part of the exchanger, a region containing sub-cooled free liquid, and at least partially neutralizes the beneficial effect of increasing the exchange area.

To avoid this drawback, it has been proposed (see for example U.S. Pat. No. 4,606,745) to subdivide the exchanger into several superposed exchangers, each of which is immersed in a shallow bath. However, this solution has not proved to be satisfactory since a shallow bath results in a low velocity of the vaporized gas leaving the exchanger. This results in insufficient two-phase fluid flow and poorer heat exchange.

The object of the invention is to provide a bath reboiler-condenser with improved thermal performance.

For this purpose, the bath reboiler-condenser, of the type consisting of brazed plates, is, according to the invention, characterized in that it comprises:

- a lower exchanger part comprising a first brazed stack of parallel plates, of spacer corrugations and of closure bars, which define a series of first vaporization passages and a series of first heating passages;
- means for supplying the first vaporization passages with liquid to be vaporized;
- at least one upper exchanger part comprising a second brazed stack of parallel plates, of spacer corrugations and of closure bars, which define a series of second vaporization passages and a series of second heating passages;
- means for transferring the vapour coming from the top of the first vaporization passages to a lower inlet of the second vaporization passages; and
- means for delivering liquid to be vaporized into the stream of vapour which penetrates into each of the second vaporization passages.

The reboiler-condenser according to the invention may include one or more of the following characteristics, taken in isolation or in any of their technically possible combinations:

- the reboiler-condenser comprises means for accelerating the stream of vapour which penetrates each of the second vaporization passages, especially a restriction in the flow area for this stream;
- the first and second vaporization passages are bounded respectively by two separate exchanger bodies and the said transfer means comprise a collector for all of the vapour coming from the top of the first vaporization passages, this collector being connected overall to the lower inlets of all the second vaporization passages;
- the first and second vaporization passages are bounded by the same plates, the exchanger parts forming a single exchanger body in which the spacer corrugations of each vaporization passage are interrupted in order to receive the said liquid delivery means;
- the reboiler condenser includes a feed for feeding liquid to be vaporized only to the said delivery means, the said supply means receiving the excess liquid coming from the upper exchanger part;
- the said liquid feed runs into a liquid reservoir open at the top, suitable for creating a hydrostatic head above the said delivery means, this reservoir also receiving the excess liquid coming from the top of the upper exchanger part and running into a space which forms part of the said supply means;
- the said supply means are suitable for receiving the excess liquid coming from the top of the first vaporization passages; and
- the said liquid delivery means comprise perforated tubes placed at the inlet of each of the said second vaporization passages and, in these passages, the perforations of these tubes being oriented upwards.

The subject of the invention is also an air distillation plant comprising a reboiler-condenser for vaporizing low-pressure liquid oxygen by the condensation of medium-pressure nitrogen, this reboiler-condenser being as defined above.

Embodiments of the invention will now be described with the reference to the appended drawings, in which.

Figure 1:
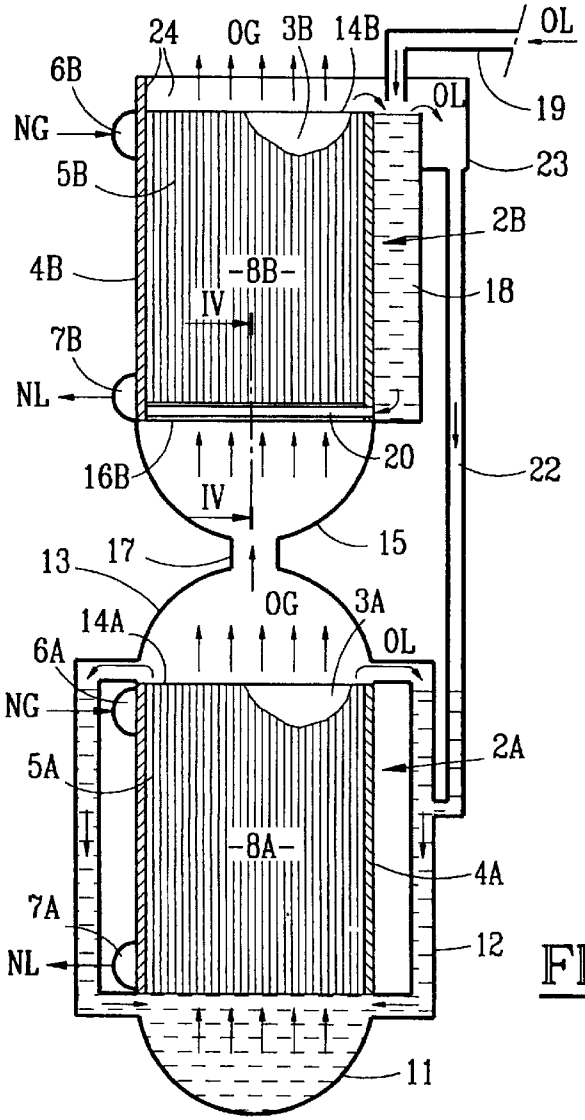
FIG. 1 shows schematically, in vertical cross section in vaporization passages, a reboiler-condenser according to the invention.

The reboiler-condenser 1 shown in FIG. 1 is the main reboiler-condenser of a double air distillation column (not shown in FIG. 1) which essentially consists of a medium-pressure distillation column and a low-pressure distillation column. The reboiler-condenser 1 is intended to vaporize the liquid oxygen in the bottom of the low-pressure column by the condensation of nitrogen gas at the top of the medium-pressure column.

The reboiler-condenser 1 consists of a lower exchanger body 2A surmounted by an upper exchanger body 2B. Each exchanger body, of parallelepidedal general shape, consists of a stack of vertical rectangular aluminium plates 3A, 3B, all identical, of peripheral closure bars 4A, 4B and of spacer corrugations 5A, 5B, for example made of perforated corrugated sheet. The assembly is furnace-brazed in a single operation. Welded to each body 2A, 2B are two boxes of semicylindrical general shape, namely an upper lateral box 6A, 6B via which nitrogen gas enters and a lower lateral box 7A, 7B via which liquid nitrogen leaves.

Each pair of adjacent plates 3 defines a passage of flat general shape. These passages are alternately oxygen vaporization passages 8A, 8B (FIG. 1) and nitrogen condensation passages. The bars 4 close the perimeter of these passages, apart from inlet/outlet apertures for the fluids.

Thus, the passages 8 are closed laterally over their entire height and are completely open at their upper and lower ends.

On the other hand, the passages 8 are closed over their entire periphery apart from an upper lateral window via which nitrogen gas enters, the box 6 opening into this window, and a lower lateral window via which liquid nitrogen leaves, the box 7 opening into this window.

The corrugations 5 of the vaporization passages have vertical generatrices over the entire height of these passages. Those of the condensation passages have vertical generatrices over most of the height of these passages, but are extended upwards and downwards by oblique delivery corrugations which run into the lateral nitrogen inlet/outlet windows, in a conventional manner.

Associated with the exchanger body 2A are:

- a liquid oxygen reserve suitable for almost completely immersing the body 2A in this liquid. This reserve may be the bottom of the low-pressure column, or else, as shown, a lower vessel 11 placed beneath the exchanger body and into which one or more down pipes 12 run;
- an upper dome 13 which sits on the upper end 14A of the body 2A. The upper end of each pipe 12 is connected to this dome level with this end 14A.

Associated with the exchanger body 2B are:

- a lower dome 15 which sits on the lower end 16B of the body 2B and communicates with the dome 13 via a pipe 17; and
- a lateral reservoir 18 which extends over the entire width, taken perpendicular to the plane of the drawing, and over the entire height of the body 2B. This reservoir is open at the top more or less level with the upper end 14B of this body 2B. Above the reservoir 18 there is the single liquid-oxygen feed 19 for the reboiler-condenser. The lower end of the reservoir 18 communicates only with devices 20 for injecting liquid oxygen into the oxygen gas, these being provided at the respective inlet of each vaporization passage 8B.

Figure 4:
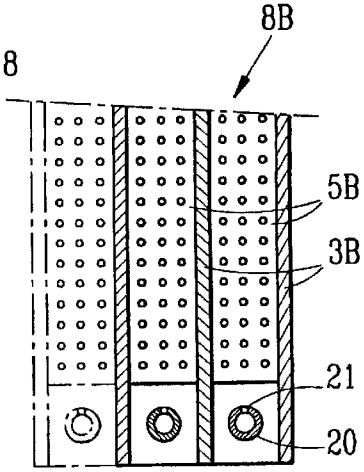
FIG. 4 is a partial view taken in cross section on the line IV—IV of FIG. 1.

As may be seen in FIG. 4, each device 20 consists of a perforated tube which extends over the entire horizontal width of the passage 8B, at the lower inlet of the latter, the corrugation 5B starting above this tube. The diameter of the tube 20 is less than the separation between the two plates 3B which define the passage, and the perforations 21 are oriented upwards. Each tube 20 is connected via one end to the bottom of the reservoir 18, while its other end is closed.

The reboiler-condenser also includes a down pipe 22 which constitutes the single feed for the lower body 2A. The inlet of this pipe forms a collector 23 open at the top, fastened to the upper edge of the reservoir 18, while its outlet is tapped into at least one pipe 12 at an intermediate point along the length thereof.

Moreover, the upper edge of the body 2B is provided with vertical rims 24 which direct, into the reservoir 18, all of the liquid oxygen leaving the upper end 14B and which direct, into the collector 23, all of the liquid which overflows from the reservoir 18.

In operation, the flow rate of liquid oxygen arriving at 19 is regulated so that, with the overflow from the reservoir 18, the level of the liquid in the lower body 2A is kept near the upper end 14A of the latter. This regulation may be achieved, for example, by regulating the flow rate of liquid products withdrawn from the plant and/or by regulating the turbine for refrigerating the latter.

The liquid oxygen partially vaporizes in the passages 8A, where the bubbles resulting from the vaporization create an upward thermosiphon effect. The two-phase fluid which leaves the upper end 14A divides into a liquid phase, which runs into the pipes 12 and returns to the lower bath, and a vapour phase, which is collected by the dome 13 and then passes into the dome 15 via the pipe 17.

This oxygen gas penetrates all the passages 8B. At the inlet of each of them, it is accelerated while passing through the tube 20, because of the reduced flow area which is presented to it, and carries away, upwards, the liquid droplets which leave the orifices 21 due to the effect of the hydrostatic head of the liquid present in the reservoir 18. The oxygen gas is thus intimately mixed with the liquid oxygen at the inlet of the passages 8B and carries this liquid away, and the vaporization continues from the bottom of these passages upwards. The two-phase fluid which leaves the upper end 14B separates into a vapour phase, which rises into the low-pressure column, and a liquid phase, which overflows into the reservoir 18.

The pipe 22 is fed only via the overflow of the reservoir 18, thereby guaranteeing that the passages 8B are sufficiently fed with liquid to avoid any drying-out in these passages. The lower part of this pipe 22 forms a liquid trap which forces all of the oxygen vaporized in the body 2A to pass into the domes 13 and 15.

By virtue of the arrangement described above, a bath of partial height is used for the lower exchanger body, thereby reducing the hydrostatic head at the inlet of the passages 8A and therefore the pressure of the heating nitrogen. Simultaneously, an accelerated two-phase flow is created in the upper exchanger, without a bath of free liquid, thereby improving the heat exchange in the upper body 2B.

Figure 2:
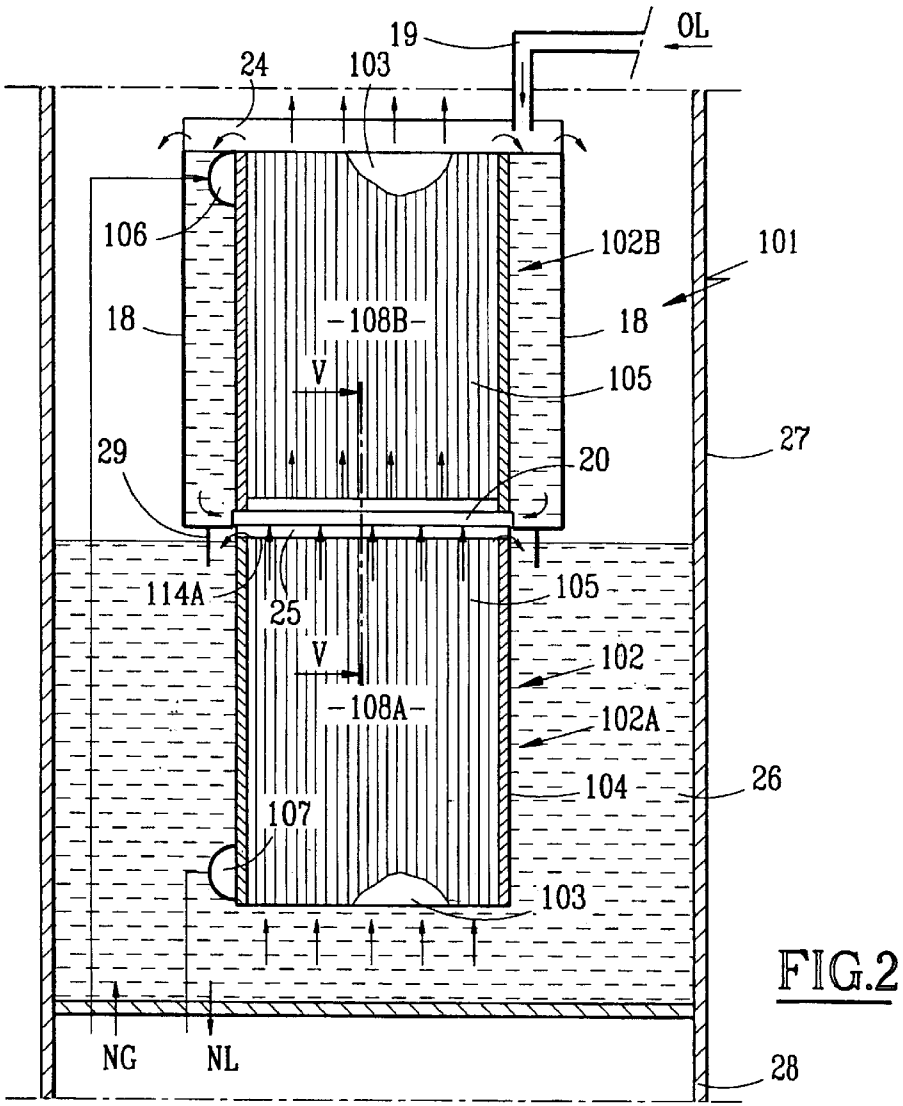
FIG. 2 is a similar view of another embodiment.
Figure 3:
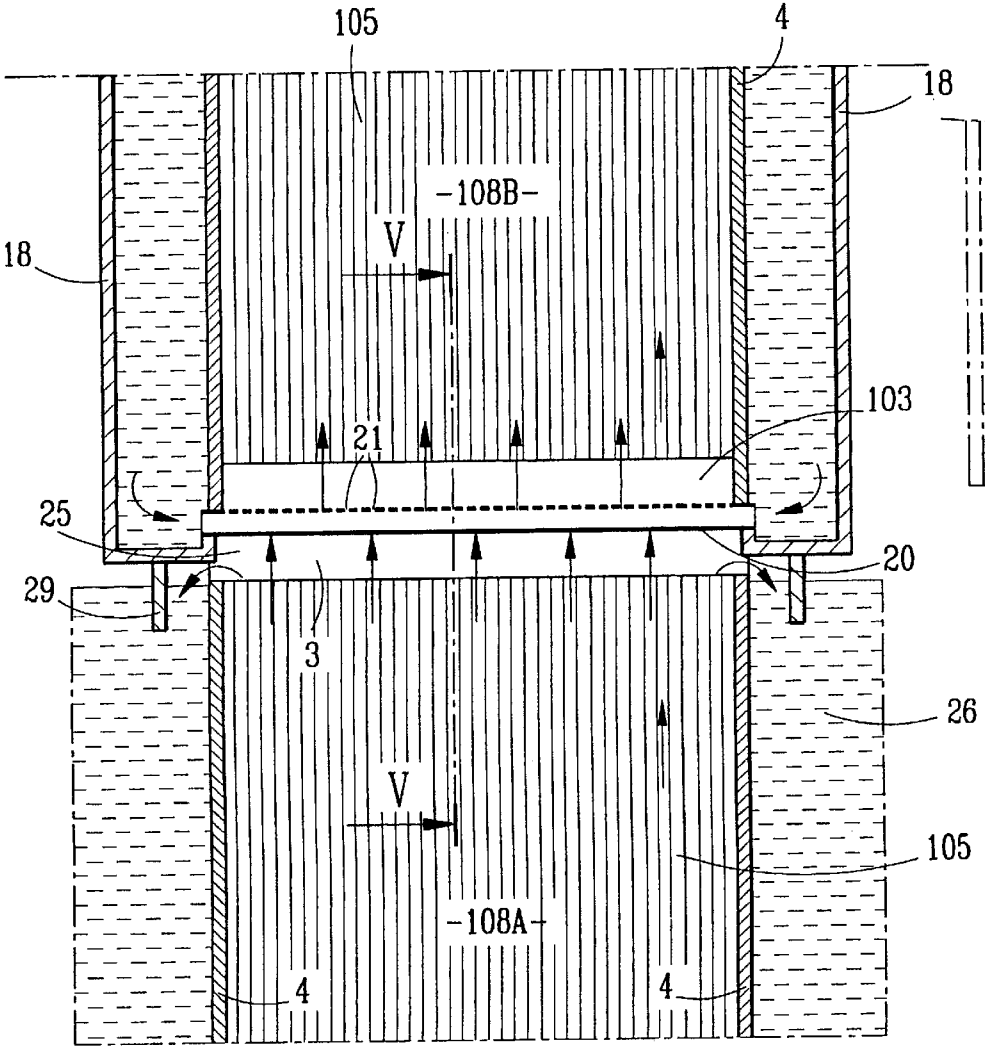
FIG. 3 is a similar view on a larger scale of the connection region between the two exchanger parts of the reboiler-condenser of FIG. 2.

FIGS. 2, 3 and 4 show a reboiler-condenser 101 which combines all the functions of the reboiler-condenser 1 in a single exchanger body 102, with a particularly simple construction.

The reboiler-condenser 101 thus consists of a single stack of vertical rectangular plates 103, of closure bars 104 and of spacer corrugations 105.

The nitrogen condensation passages extend continuously over the entire height of the exchanger, with a single upper inlet box 106 and a single lower outlet box 107, both boxes being placed laterally.

Figure 5:
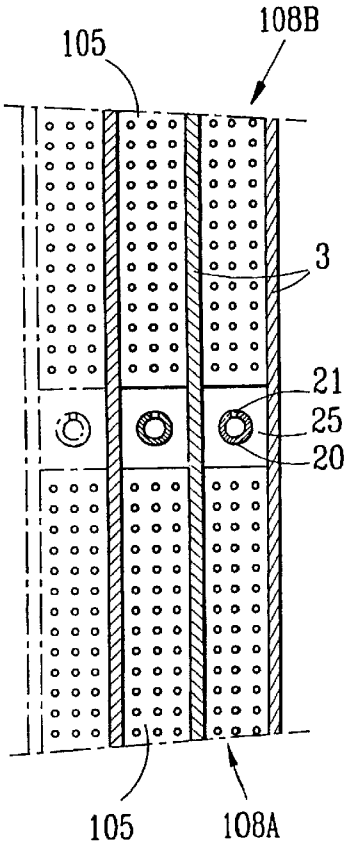
FIG. 5 is a partial view taken in cross section on the line V—V of FIG. 2 or of FIG. 3.

The oxygen vaporization passages 108 are closed laterally over their entire height and are completely open at the top and at the bottom. Their spacer corrugations 105, having vertical generatrices, are interrupted at an intermediate position along their length. Placed in each free space 25 thus defined is a perforated tube 20 having orifices 21 oriented upwards (FIG. 5), with the arrangement described above with regard to FIG. 4. However, in this case the tubes 20 are open at both their ends and run into the lower part of a lateral reservoir 18 which surrounds the exchanger body through corresponding holes in the lateral closure bars of the passages 108.

Defined in this way, as in the case of FIG. 1, are a lower exchanger part 102A, containing lower vaporization passages 108A, and an upper exchanger part 102B, containing upper vaporization passages 108B with, between these passages, a space 25 for collecting and for redistributing oxygen gas, which space corresponds to the space 13, 17, 15 described above.

The lower part 102A of the exchanger, more or less just level with the upper end 114A of the passages 108A, is immersed directly in a liquid oxygen bath 26 collected in the bottom of the low-pressure column 27, which column sits on top of the medium-pressure column 28.

To guarantee that all of the oxygen vaporized in the part 102A passes into the part 102B, a vertical partition 29 starting from the base of the reservoir 18 surrounds the upper region of the part 102A and is immersed in the bath 26.

The reboiler-condenser is fed with liquid oxygen only at 19, into the reservoir 18. The reservoir 18 also receives the excess liquid oxygen leaving the top of the exchanger. As above, the reservoir 18 feeds the tubes 20 and the liquid which leaves from the orifices 21 is intimately mixed with the vapour phase of the two-phase mixture coming from the lower part 102A of the exchanger. As regards the liquid phase of this mixture, this runs into the bath 26. The latter is also fed via the overflow of the reservoir 18. These various fluid movements are indicated by arrows in FIG. 2, and the resulting advantages are similar to those explained above with regard to FIGS. 1 and 4.

As will have been understood, the immersed lower part 8A or 102A of the reboiler-condenser may, as a variant, be additionally surmounted by an exchanger part such as 8B or 102B, the vaporization passages of which are fed, on the one hand, with oxygen gas coming from the subjacent exchanger stage and, on the other hand, with liquid oxygen intimately mixed with this oxygen gas at their inlet. In such a variant, the entire reboiler-condenser is preferably fed with liquid oxygen only at the highest stage and then, from each stage to the subjacent stage, by overflow.

What is claimed is:

1. Bath reboiler-condenser (1; 101), of the type consisting of brazed plates, characterized in that it comprises:

a lower exchanger part (2A; 102A) comprising a first brazed stack of parallel plates (3A; 3), of spacer corrugations (5A; 105) and of closure bars (4A; 104), which define a series of first vaporization passages (8A; 108A) and a series of first heating passages;

means (11, 12; 26) for supplying the first vaporization passages (8; 108A) with liquid to be vaporized;

at least one upper exchanger part (8B; 108B) comprising a second brazed stack of parallel plates (3B; 3), of spacer corrugations (5B; 105) and of closure bars (4B; 104), which define a series of second vaporization passages (8B; 108B) and a series of second heating passages;

means (13, 15, 17; 25) for transferring the vapour coming from the top of the first vaporization passages (8A; 108A) to a lower inlet of the second vaporization passages (8B; 108B); and means (20) for delivering liquid to be vaporized into the stream of vapour which penetrates into each of the second vaporization passages (BB; 108B).

2. Reboiler-condenser according to claim 1, characterized in that it comprises means for accelerating the stream of vapour which penetrates each of the second vaporization passages (8B; 108B), especially a restriction in the flow area for this stream.

3. Reboiler-condenser according to claim 1, characterized in that the first and second vaporization passages are bounded respectively by two separate exchanger bodies (2A, 2B) and in that the said transfer means comprise a collector (13) for all of the vapour coming from the top of the first vaporization passages (8A), this collector being connected overall (at 15) to the lower inlets of all the second vaporization passages (8B).

4. Reboiler-condenser according to claim 1, characterized in that the first (108A) and second (108B) vaporization passages are bounded by the same plates (103), the exchanger parts (102A, 102B) forming a single exchanger body (102) in which the spacer corrugations (105) of each vaporization passage are interrupted (at 25) in order to receive the said liquid delivery means (20).

5. Reboiler-condenser according to claim 1, characterized in that it includes a feed (19) for feeding liquid to be vaporized only to the said delivery means, the said supply means (11, 12; 26) receiving the excess liquid coming from the upper exchanger part (102B).

6. Reboiler-condenser according to claim 5, characterized in that the said liquid feed (19) runs into a liquid reservoir (18) open at the top, suitable for creating a hydrostatic head above the said delivery means (20), this reservoir also receiving the excess liquid coming from the top of the upper exchanger part (102B) and running into a space (12; 26) which forms part of the said supply means.

7. Reboiler-condenser according to claim 1, characterized in that the said supply means (11, 12; 26) are suitable for receiving the excess liquid coming from the top of the first vaporization passages (8A; 108A).

8. Reboiler-condenser according to claim 1, characterized in that the said liquid delivery means (20) comprise perforated tubes placed at the inlet of each of the said second vaporization passages (8B; 108B) and, in these passages, the perforations (21) of these tubes being oriented upwards.

9. Air distillation plant, comprising a reboiler-condenser for vaporizing low-pressure liquid oxygen by the condensation of medium-pressure nitrogen, characterized in that the reboiler-condenser (1; 101) is according to claim 1.

* * * * *